US009756902B2

(12) United States Patent
Shirley

(10) Patent No.: US 9,756,902 B2
(45) Date of Patent: Sep. 12, 2017

(54) SHOE TONGUE BRACKET

(71) Applicant: Robert Wesley Shirley, Jonesboro, GA (US)

(72) Inventor: Robert Wesley Shirley, Jonesboro, GA (US)

( * ) Notice: Subject to any disclaimer, the term of this patent is extended or adjusted under 35 U.S.C. 154(b) by 0 days.

(21) Appl. No.: 14/832,382

(22) Filed: Aug. 21, 2015

(65) Prior Publication Data

US 2017/0049188 A1 Feb. 23, 2017

(51) Int. Cl.

| | |
|---|---|
| ***A43B 13/14*** | (2006.01) |
| ***A43B 23/26*** | (2006.01) |
| ***A43C 5/00*** | (2006.01) |
| ***A43C 11/14*** | (2006.01) |
| ***A43C 11/20*** | (2006.01) |

(52) U.S. Cl.

CPC ..... *A43B 23/26* (2013.01); *A43C 5/00* (2013.01); *A43C 11/14* (2013.01); *A43C 11/20* (2013.01); *Y10T 24/3703* (2015.01)

(58) Field of Classification Search

CPC ..... A43B 23/26; A43C 5/00; A43C 11/14; A43C 11/20; Y10T 24/44983; Y10T 24/3703

USPC ..... 36/50.1; 248/441.1, 448

See application file for complete search history.

(56) References Cited

U.S. PATENT DOCUMENTS

| | | | | | |
|---|---|---|---|---|---|
| 393,521 | A * | 11/1888 | Roys | B42F 9/00 | 24/336 |
| 523,557 | A * | 7/1894 | Tower | A41F 17/02 | 24/72.1 |
| 780,020 | A * | 1/1905 | Brent | A43C 1/00 | 24/372 |
| 1,155,354 | A * | 10/1915 | Hallock | A43B 23/26 | 36/54 |
| 1,359,981 | A * | 11/1920 | Fry | A41B 3/08 | 24/545 |
| 1,885,995 | A * | 11/1932 | Dowick | A45D 8/34 | 132/273 |
| 2,049,932 | A * | 8/1936 | Voit | A43C 9/06 | 24/713 |
| 2,289,225 | A * | 7/1942 | Tonai | A43C 11/22 | 24/300 |
| 3,323,232 | A * | 6/1967 | Danowsky | A43B 7/1495 | 36/76 R |
| 3,456,366 | A * | 7/1969 | Boeing | A43B 5/02 | 36/58.5 |
| 4,210,983 | A * | 7/1980 | Green | A43C 11/22 | 24/575.1 |
| 4,474,383 | A * | 10/1984 | Kikis | B42D 9/00 | 16/257 |

(Continued)

*Primary Examiner* — Katharine Gracz
(74) *Attorney, Agent, or Firm* — Dunlap Bennett & Ludwig PLLC

(57) ABSTRACT

A shoe tongue bracket is provided. The bracket is formed of a band having a first end, a second end, and a middle portion in between. A middle bend is formed at the middle portion and is shaped to contour with an underside of a shoe tongue. A first end bend is formed at the first end and bends in an opposite direction of the middle bend. A second end bend is formed at the second end and is bending in an opposite direction of the middle bend. A first aperture is formed through the band at the first end and a second aperture is formed through the band at the second end.

4 Claims, 2 Drawing Sheets

(56) References Cited

U.S. PATENT DOCUMENTS

| | | | | | |
|---|---|---|---|---|---|
| 4,767,094 | A * | 8/1988 | Brown | B42D 9/00 | 248/444.1 |
| 5,239,732 | A * | 8/1993 | Steven | A43C 1/02 | 24/575.1 |
| 5,295,315 | A * | 3/1994 | Osawa | A43C 11/06 | 24/712 |
| 5,379,529 | A * | 1/1995 | Smith | A43B 5/00 | 36/50.1 |
| 5,943,793 | A * | 8/1999 | Clements | A43C 5/00 | 36/50.1 |
| 6,073,370 | A * | 6/2000 | Okajima | A43B 5/04 | 36/50.1 |
| 6,397,497 | B1 * | 6/2002 | McAtee | B65H 23/24 | 242/615.11 |
| 6,438,871 | B1 * | 8/2002 | Culverwell | A43C 11/00 | 24/578.14 |
| 7,062,867 | B2 * | 6/2006 | Meibock | A43B 1/0072 | 36/50.1 |
| 8,375,602 | B2 * | 2/2013 | Takada | A43C 1/00 | 36/50.1 |
| 2003/0221334 | A1 * | 12/2003 | McFee | A43C 11/22 | 36/50.1 |
| 2006/0254089 | A1 * | 11/2006 | Frydlewski | A43C 11/00 | 36/50.1 |
| 2011/0094126 | A1 * | 4/2011 | Walker | A43B 11/00 | 36/136 |
| 2012/0117819 | A1 * | 5/2012 | Atamian | A43C 1/02 | 36/50.1 |
| 2012/0124863 | A1 * | 5/2012 | Aveni | A43B 23/0215 | 36/50.1 |
| 2013/0097887 | A1 * | 4/2013 | Robinson | A43B 23/0245 | 36/54 |

* cited by examiner

SHOE TONGUE BRACKET

BACKGROUND OF THE INVENTION

The present invention relates to shoe tongues and, more particularly, to a shoe tongue bracket.

A shoe is an item of footwear intended to protect and comfort the human foot while doing various activities. Most shoes include an upper and a sole. Most uppers have a mechanism, such as laces, straps with buckles, zippers, elastic, hook and loop fastener straps, buttons, or snaps, for tightening the upper on the foot. Uppers with laces usually have a tongue that helps seal the laced opening and protect the foot from abrasion by the laces. Currently, the tongue has a tendency to slide from the middle to a side of the foot while using the shoe As can be seen, there is a need for a bracket to prevent the tongue from sliding.

SUMMARY OF THE INVENTION

In one aspect of the present invention, a shoe tongue bracket comprises: a band comprising a first end, a second end, and a middle portion in between, wherein a middle bend is formed at the middle portion and is shaped to contour with an underside of a shoe tongue, a first end bend formed at the first end and bending in an opposite direction of the middle bend, and a second end bend formed at the second end and bending in an opposite direction of the middle bend, and wherein a first aperture is formed through the band at the first end and a second aperture is formed through the band at the second end.

In another aspect of the present invention, a method of centering a shoe tongue comprises: providing a shoe tongue bracket comprising a first end and a second end, and comprising a middle bend, and a first end bend forming a first channel and a second end bend forming a second channel, wherein a first aperture is formed through the first end and a second aperture is formed through the second end; placing the middle bend underneath a tongue of a shoe; placing a first side edge of the tongue within the first channel; placing a second side edge of the tongue within the second channel; placing a first end of a shoe lace through the first aperture; and placing a second end of a shoe lace through the second aperture.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a shoe tongue bracket having upward U-shaped curves on both ends with eyelets to receive the shoestring of footwear. The shoestring passes through the eyelets, thereby holding the tongue in place. The curved ends allow the bracket to be placed between the upper outer portion of the footwear and the tongue of the shoe. The bracket also curves below the tongue of the shoe to the opposite side where the bracket similarly is placed between the body of the shoe and the tongue.

Figure 1:
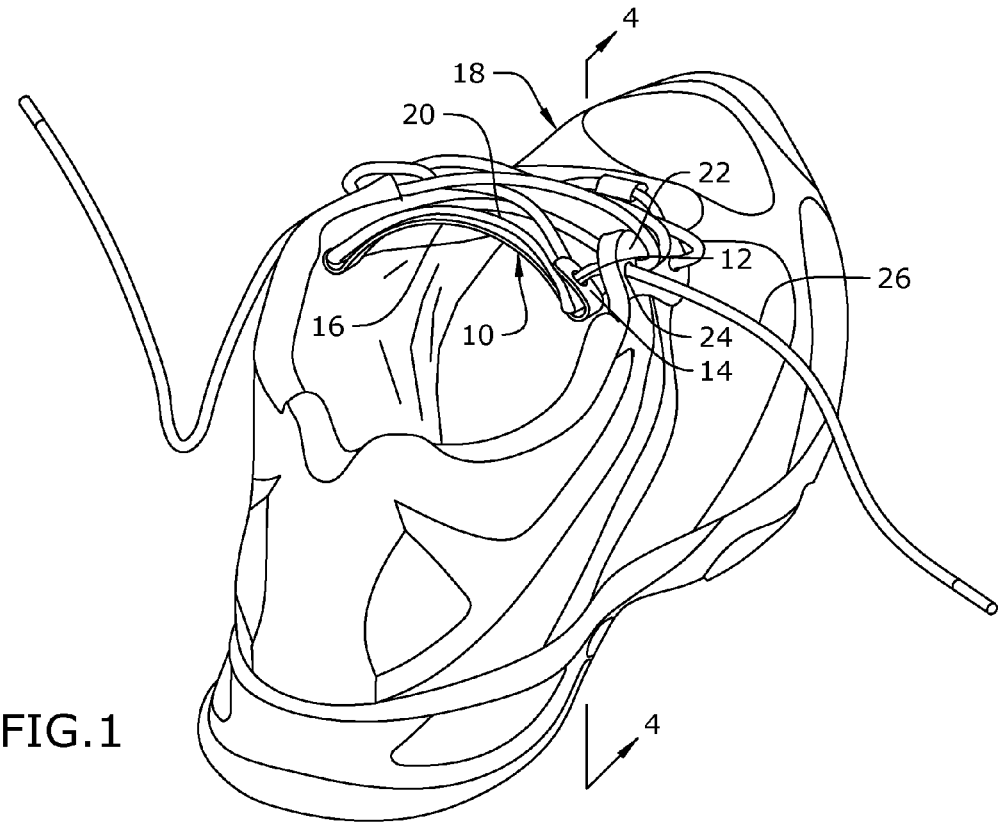
FIG. 1 is a perspective view of an embodiment of the present invention shown in use.
Figure 2:
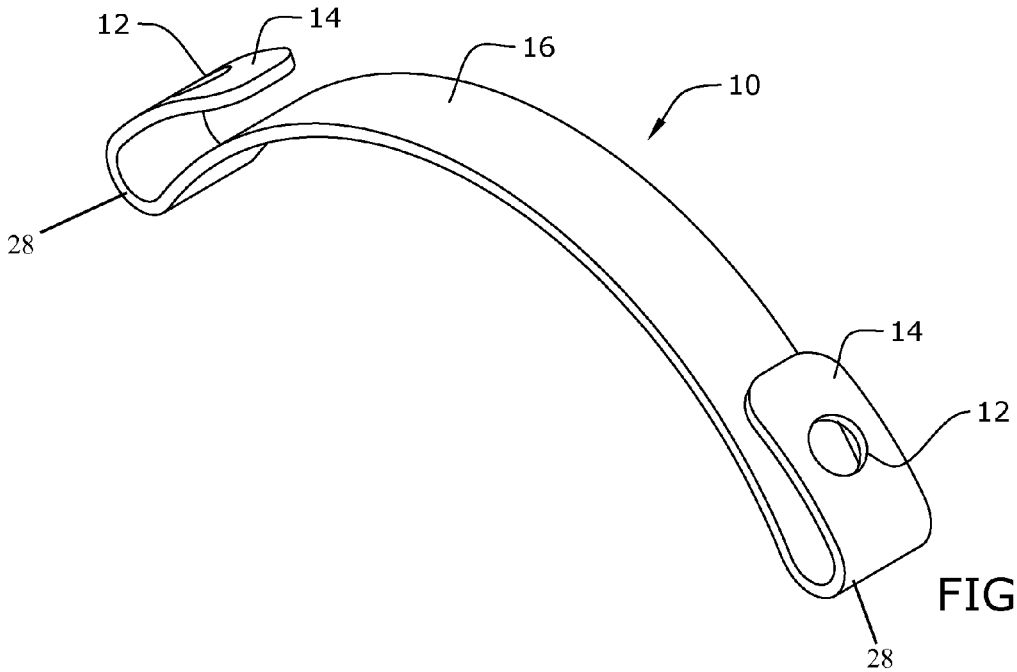
FIG. 2 is a front top perspective view of an embodiment of the present invention.
Figure 3:
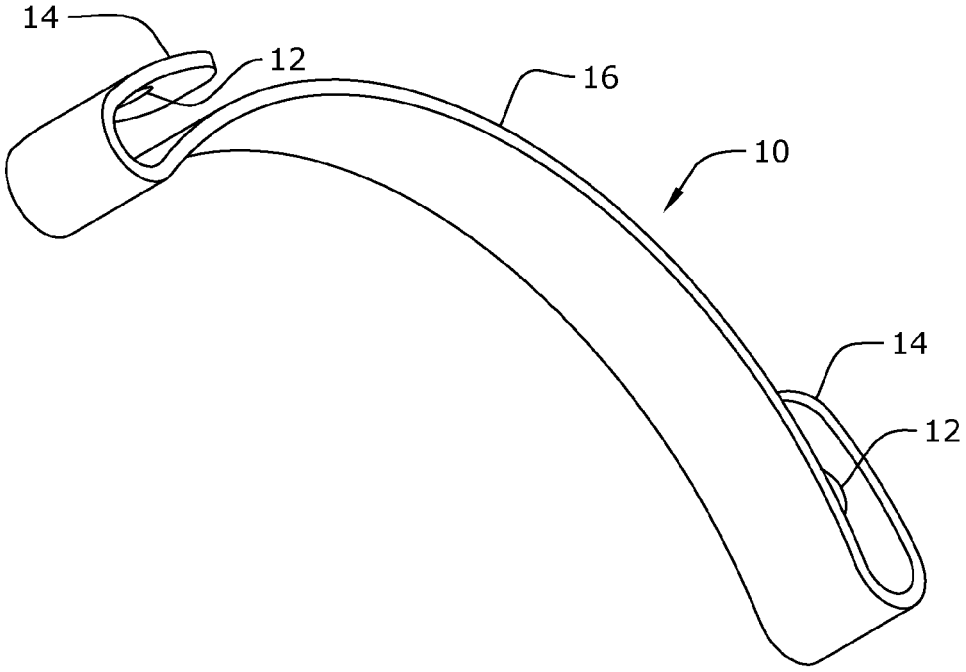
FIG. 3 is a rear bottom perspective view of an embodiment of the present invention.
Figure 4:
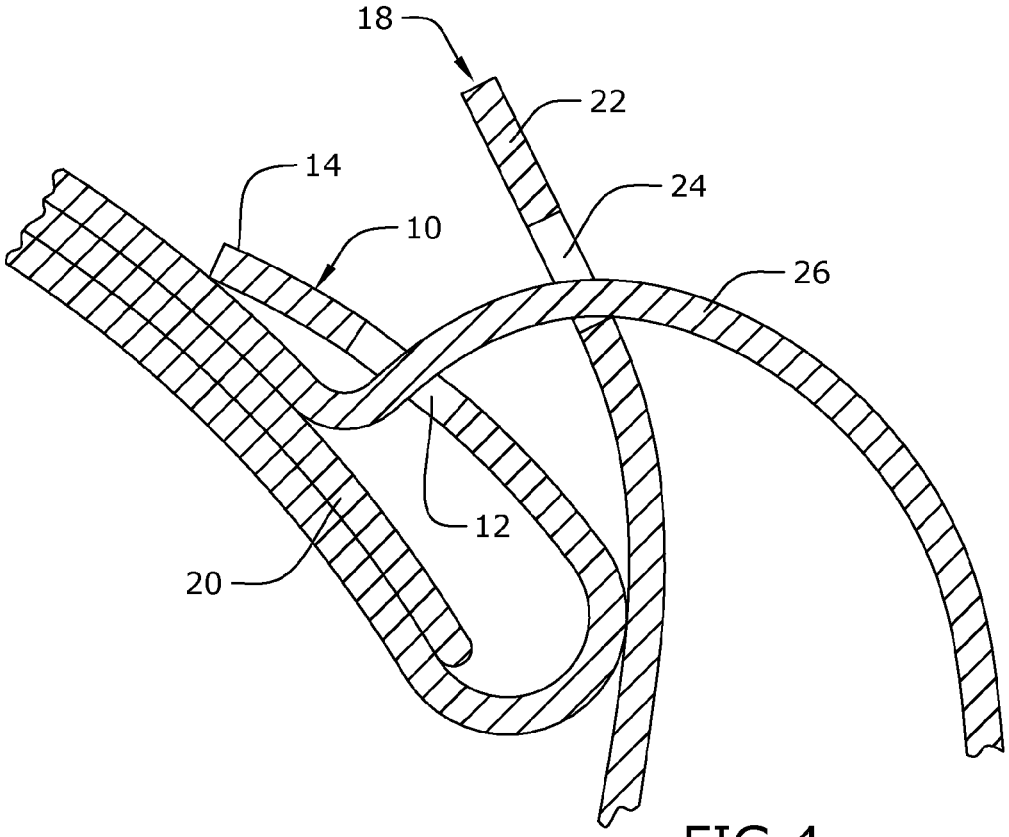
FIG. 4 is a section view of the present invention shown in use along line 4-4 in FIG. 1.

Referring to FIGS. 1 through 5, the present invention includes a shoe tongue bracket 10. The bracket 10 is formed of a band having a first end, a second end, and a middle portion in between. A middle bend 16 is formed at the middle portion and is shaped to contour with an underside of a shoe tongue 20. A first end bend 28 is formed at the first end and bends in an opposite direction of the middle bend 16. A second end bend 28 is formed at the second end and bends in an opposite direction of the middle bend 16. A first aperture 12 is formed through the band at the first end and a second aperture 12 is formed through the band at the second end.

The shoe bracket 10 of the present invention may be made of a semi-rigid to rigid material. For example, the shoe bracket 10 may be made of a polyethylene, polypropylene, vinyl, nylon, rubber, leather or other various impregnated or laminated fibrous materials.

In certain embodiments, the first bend 28 and the second bend 28 may be U-shaped. The U-shaped bends may be at least 180 degrees relative to the middle bend. The first bend 28 may form a first channel and the second bend 28 may form a second channel. The middle bend 16 of the present invention may be semi-circular and may be is less than 180 degrees. As mentioned above, the middle bend 16 contours with the concave underside of the tongue 20.

In certain embodiments, the first aperture 12 is formed in between a tip 14 of the first end and the first bend 28, and the second aperture 12 is formed in between a tip 14 of the second end and the second bend 28.

A method of centering a shoe tongue 20 may include the following. The shoe tongue bracket 10 mentioned above is provided. The middle bend 16 is placed underneath the tongue 20 of a shoe 18. A first side edge of the tongue 20 is placed within the first channel. A second side edge of the tongue 20 opposite the first side edge is placed within the second channel. A first end of a shoe lace 26 is placed through the first aperture 12 and then placed through an aperture 24 formed through the shoe side wall 22. A second end of a shoe lace 26 is placed through the second aperture 12 and then placed through an aperture 24 formed through the shoe side wall 22. The shoe tongue bracket 10 thereby centers the tongue 10 of the shoe 18. Therefore, when a user walks using the present invention, the tongue 10 of the shoe 18 is prevented from shifting side to side.

It should be understood, of course, that the foregoing relates to exemplary embodiments of the invention and that modifications may be made without departing from the spirit and scope of the invention as set forth in the following claims.

What is claimed is:

1. A method of centering a shoe tongue comprising:

providing a shoe comprising a sole, an upper attached to the sole, wherein the upper comprises opposing side walls each comprising a plurality of shoe lace apertures, and a tongue disposed in between the opposing sidewalls;

providing a shoe tongue bracket comprising a first end and a second end, and comprising a middle bend, a first end bend forming a first channel and a second end bend forming a second channel, wherein a first aperture is formed through the first end and a second aperture is formed through the second end;

placing the middle bend underneath and adjacent to the tongue of the shoe;

placing a first side edge of the tongue within the first channel so that the first aperture is adjacent to a first shoe lace aperture of the plurality of shoe lace apertures;

placing a second side edge of the tongue within the second channel so that the second aperture is adjacent to a second shoe lace aperture of the plurality of shoe lace apertures;

placing a first end of a shoe lace through the first aperture and then through the first shoe lace aperture; and placing a second end of a shoe lace through the second aperture and then through the second shoe lace aperture.

2. The method of claim 1, wherein the first bend and the second bend are formed on opposite sides of the middle bend, wherein each bend in an opposite direction of the middle bend.

3. The method of claim 1, wherein the first aperture is formed in between a tip of the first end and the first bend, and the second aperture is formed in between a tip of the second end and the second bend.

4. The method of claim 1, wherein the first bend and the second bend are U-shaped bends.

* * * * *